United States Patent [19]

Keeffe et al.

[11] 4,321,504

[45] Mar. 23, 1982

[54] LOW WATTAGE METAL HALIDE ARC DISCHARGE LAMP

[75] Inventors: William M. Keeffe, Rockport; Harold L. Rothwell, Jr., Rowley; John A. Scholz, Danvers, all of Mass.

[73] Assignee: GTE Products Corporation, Stamford, Conn.

[21] Appl. No.: 132,933

[22] Filed: Mar. 24, 1980

[51] Int. Cl.[3] ..... H01J 1/88; H01J 61/30

[52] U.S. Cl. ..... 313/214; 313/220; 313/229

[58] Field of Search ..... 313/217, 220, 227, 228, 313/221, 223, 317, 284–286, 182–186, 210, 214, 229

[56] References Cited

U.S. PATENT DOCUMENTS 3,593,056 7/1971 Degawa ..... 313/220

3,900,754 8/1975 Mason et al. ..... 313/221

*Primary Examiner*—Marvin L. Nussbaum

*Attorney, Agent, or Firm*—James Theodosopoulos

[57] ABSTRACT

A low wattage metal halide arc discharge lamp has a press seal at one end thereof with two main electrodes sealed therein. The ratio of the distance from an electrode tip to the nearest arc tube wall over the arc length is greater than 0.4.

5 Claims, 2 Drawing Figures

LOW WATTAGE METAL HALIDE ARC DISCHARGE LAMP

TECHNICAL FIELD

This invention is concerned with high pressure metal halide arc discharge lamps. Such lamps generally comprise a fused quartz envelope containing a fill including mercury, metal halide and a starting gas.

BACKGROUND ART

Background art for high pressure metal halide arc discharge lamps is shown in U.S. Pat. No. 3,761,758 and the patents listed therein. Said patents disclose lamps having a double-ended arc tube, that is to say, an elongated arc tube having an electrode at each end. Our invention is particularly concerned with low wattage metal halide lamps; such lamps are discussed in U.S. Pat. No. 4,161,672 which also discloses the use of double-nded arc tubes therefor.

DISCLOSURE OF INVENTION

This invention discloses low wattage metal halide arc discharge lamps having press sealed single-ended arc tubes, that is to say, an arc tube in which both electrodes are located in a press seal at one end of the arc tube. Such arc tubes are less fragile and more suitable for manufacture on high speed equipment than those disclosed in U.S. Pat. No. 4,161,672.

We have found that in order to provide a single-ended metal halide lamp having a reasonably long life for general illumination purposes, say, several thousand hours, it is necessary to control the ratio of the distance from the tip of the electrode to the nearest arc tube inside wall over the tip-to-tip interelectrode gap. Said ratio must be greater than 0.4 to insure long life and acceptable lumen maintenance throughout lamp life.

There are presently available single-ended metal halide projector lamps in high wattages of 400 and 1000 watts. The single-ended lamps of our invention differ from said projector lamps in several respects, in addition to the difference in wattage. The projector lamps have a rated life of only 1000 hours or less and are quite heavily loaded, say, about 50 watts per square centimeter of arc tube wall area. Moreover, the above mentioned ratio in said projector lamps is less than 0.4.

BEST MODE FOR CARRYING OUT THE INVENTION

Figure 1:
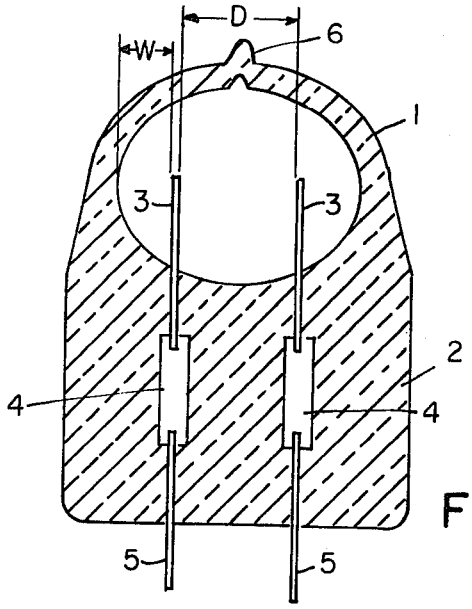
FIG. 1 is a sectional view parallel to the press seal of a single ended metal halide are discharge lamp in accordance with this invention.

Conventional sizes of high pressure metal halide arc discharge lamps general incorporate pressed ribbon-seal construction in which a pair of electrodes are sealed into the distal end of a quartz arc tube. Energy balance studies of such lamps have shown that the average power loss to each electrode is given by the following equation:

$$P_E = I_{rms} \times \frac{V_{A+K}}{2}$$

where $P_E$ is the average power loss to each electrode, $I_{rms}$ is the rms lamp current and $V_{A+K}$ is the average value of the anode-plus-cathode fall for 50–60 Hz operation. Typical values for $V_{A+K}$ are shown in Table I.

TABLE I

| Lamp Type | $V_{A+K}$ volts |
|---|---|
| High Pressure Mercury | 9.52 |
| High Pressure Sodium | 5.39 |
| Scandium-sodium iodide | 11.50 |
| Indium, thalium-sodium iodide | 10.59 |
| Dysprosium iodide | 11.25 |
| Tin iodide | 10.36 |

Thus, for a conventional 400 watt scandium-sodium iodide lamp operating at 3.3 amperes rms, the power loss to each of the two electrodes, given by the above equation, is 19 watts; thus about 10% (38watts) of the input power is lost to the electrode pair. We have found that most of this energy is conducted into the arc tube press seal region, from which it is dissipated primarly as thermal radiation, and to a lesser extent by conduction to the mounting supports. As one decreases the length of the arc tube, as would be done in scaling down to a low wattage design, these end losses are not in general reduced in proportion to the input power. The reason for this may be explained by an examination of the above equation. Since $V_{A+K}$ is fixed for a given lamp type, $P_E$ can only be reduced by a corresponding reduction in the lamp current, $I_{rms}$. For lamp wattages of 30–60 watts, the lamp current reduction needed, about ten-fold, requires an increase in the mercury buffer vapor pressure, which we have found results in generaly poorer lumen maintenance, undesirable plasma instabilities, and may lead to containment difficulties.

The use of a single-ended arc tube as per this invention reduces the end losses without suffering the aforementioned disadvantages. As shown in the drawing, arc tube 1 has a press seal 2 at one end thereof. Electrodes 3 are connected to molybdenum ribbons 4, which are embedded in press seal 2, and extend into arc tube 1. Ribbons 4 are connected to external lead-in wires 5. There is an exhaust tube tip-off 6 on arc tube 1 opposite press seal 2.

The distance between electrodes 3, shown as D in the drawing, is related to the distance from the tip of electrode 3 to the nearest inside wall of arc tube 1, shown as W in the drawing. For purposes of this invention, the ratio of W/D must be greater than 0.4. For ratios less than 0.4, we find that wall reactions shorten lamp life and adversely affect lumen maintenance.

Figure 2:
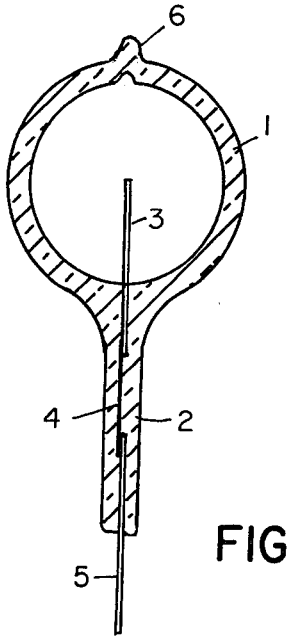
FIG. 2 is a sectional view thereof orthogonal to the press seal.

In a specific example for a 40 watt lamp in accordance with this invention, arc tube 1 was made from a 20 mm length of T3 fused quartz tubing (about 9.4 mm O.D. by 7.4 mm I.D.), to one end of which had been fused a 4 mm O.D. exhaust tube. An electrode assembly, comprising 20 mil diameter thoriated tungsten electrodes 3, 89 mil wide molybdenum ribbons 4, and 30 mil diameter molybdenum lead-in wires 5, was inserted into the quartz tubing which was pressed, in a softened condition, between two jaws, onto the electrode assembly to form press seal 2. The jaws were curved at one end to provide the somewhat ovoid shape to arc tube 1 shown in FIG. 1. In addition, during pressing, gaseous pressure was introduced through the exhaust tube to form arc tube 1 into the shapes shown in FIGS. 1 and 2, that is to say, somewhat ovoid in a section parallel to press seal 2 and somewhat spherical in a section orthogonal to press seal 2. It is believed that shaping arc tube 1 in such a manner improves lamp life. In addition, such shaping alleviates the problem with crevices between electrodes 3 and press seal 2 that is discussed in copending application Ser. No. 71,437, filed Aug. 31, 1979, entitled "Metal Halide Arc Discharge Lamp Having Color Uniformity". A filling of 9.1 mg mercury, 0.65 mg mercuric iodide, 1.0 mg sodium iodide, 0.2 mg of scandium metal and argon at 200 torr was then added through the exhaust tube, which was then sealed. The arc length (distance D) was 3.1 mm and the shortest distance from the tip of an electrode 3 to the nearest wall (distance W) was 1.4 mm. The ratio W/D was 0.45. The loading on the lamp was about 11 watts per square centimeter of arc tube wall area.

At 0 hours, the luminous flux from the lamp was 3010 lumens, at 53 volts, 0.873 ampers. At 100 hours, the luminous flux was 2440 lumens, at 64 volts, 0.766 amperes.

Lamps in accordance with this invention have been life-tested for several thousand hours. At 5800 hours, the maintenance of such lamps was 80% of the 100 hour lumens.

We claim:

1. A low wattage metal halide arc discharge lamp comprising: an arc tube having a press seal at one end thereof and containing a fill including mercury, a halide and a starting gas; and two main electrodes embedded in said press seal and extending into the arc tube, the distance between the internal tips of the electrodes being a predetermined distance denominated D, the shortest distance between the internal tip of an electrode and the nearest arc tube inside wall being denominated W, the ratio of W/D being greater than 0.4.

2. The lamp of claim 1 wherein an exhaust tube tip-off is located on the end of the arc tube opposite the press seal.

3. A low wattage metal halide arc discharge lamp comprising: an arc tube having a press seal at one end thereof and containing a fill including mercury, a halide and a starting gas; and two main electrodes embedded in said press seal and extending into the arc tube, the arc tube having a substantially ovoid shape in a section parallel to the press seal and a substantially spherical shape in a section orthogonal to the press seal.

4. The lamp of claim 3 wherein the distance between the internal tips of the electrodes is a predetermined distance denominated D, the shortest distance between the internal tip of an electrode and the nearest arc tube inside wall is denominated W and the ratio of W/D is greater than 0.4.

5. The lamp of claim 3 wherein an exhaust tube tip-off is located on the end of the arc tube opposite the press seal.

* * * * *